US008181781B2

(12) United States Patent
Gold

(10) Patent No.: US 8,181,781 B2
(45) Date of Patent: May 22, 2012

(54) BEVERAGE MIXING PACKAGING CONFIGURATION AND DISPENSER

(76) Inventor: Scott D. Gold, Santa Cruz, CA (US)

( * ) Notice: Subject to any disclaimer, the term of this patent is extended or adjusted under 35 U.S.C. 154(b) by 0 days.

(21) Appl. No.: 12/787,347

(22) Filed: May 25, 2010

(65) Prior Publication Data

US 2011/0290691 A1 Dec. 1, 2011

(51) Int. Cl.
*B65D 77/00* (2006.01)
*B65D 71/00* (2006.01)
*B01F 13/00* (2006.01)

(52) U.S. Cl. ..... 206/427; 206/217; 206/568; 366/130

(58) Field of Classification Search ..... 206/217, 206/218, 427–435, 541–549, 219, 568; 366/130
See application file for complete search history.

(56) References Cited

U.S. PATENT DOCUMENTS 2,236,368 A * 3/1941 Haaker ..... 206/217
3,347,354 A * 10/1967 West ..... 206/541
4,174,779 A * 11/1979 Slone ..... 206/427
4,194,619 A * 3/1980 Schley ..... 206/217
6,105,821 A * 8/2000 Christine et al. ..... 222/105
6,439,757 B2 * 8/2002 Lloyd ..... 366/130
6,652,134 B2 * 11/2003 Lloyd ..... 366/130

FOREIGN PATENT DOCUMENTS

DE 3505290 A1 * 8/1986
JP 5270568 A * 10/1993

* cited by examiner

*Primary Examiner* — Bryon Gehman
(74) *Attorney, Agent, or Firm* — Deborah Wenocur; Lael Andara

(57) ABSTRACT

A product configuration is provided for the packaging of non-mixed beverages and dispensing configuration for mixing of a base beverage and mix beverage into a preferred single-serve mixed drink. The product configuration, called a multi-beverage packaging configuration includes a plurality of base beverage containers, containing a first beverage which may be carbonated, with one or more mix beverage containers, containing one or more mix beverage-for separate consumption or mixing, and one or more volumetric dispensers. The volume of the mix beverage is proportionally divisible by the number of base beverage containers in the product configuration and the division of which is equal to the volume of the volumetric dispenser. The ratio of mix beverage to base beverage in the mixed drink is dependent on the number of base beverage containers in the product configuration, and on the volume of the volumetric dispenser.

12 Claims, 5 Drawing Sheets

BEVERAGE MIXING PACKAGING CONFIGURATION AND DISPENSER

TECHNICAL FIELD

The present disclosure relates to storage and housing of different beverage containers in a single package, such as beer and spirits, wherein the different beverages are packaged separately, until such time as they are consumed or mixed for consumption using the dispensing device that allows for the correct proportion of different beverages into a mixed beverage.

BACKGROUND

At the present time it is known to package and store beverages in cans and bottles as used in the invention herein. The field of relevant art includes the packaging of alcoholic beverages, which may be carbonated. Also relevant to this invention is the packaging and storage of two different beverages in a single container, or two different materials that out of necessity cannot be combined until dispensing.

Consumers of alcoholic beverages, both those interested in private consumption and those involved in festive occasions or parties regardless of size, commonly purchase both beer and spirits separately, and then transport the beer and spirits separately to consume either separately or mixed. This results in inconvenience, sometimes difficulty transporting both products at the same time, and often the wrong mixed ratio upon dispensing.

FIELD OF INVENTION

The present invention relates generally to a bundle configuration involving packaging and storage of different beverages in separate containers within the same package and the proper ratio dispensing thereof upon consumption or mixing. It allows the consumer to transport the un-mixed beverages and then, using the dispensing apparatus included within, obtain the correct ratio of the different beverages for mixing or individual parallel consumption. Furthermore, the configuration was created to comply with alcohol packaging laws.

SUMMARY

The disclosed invention teaches a plurality of different beverage containers within the same packaging, wherein the individual beverage containers and one or more volumetric dispensers are enclosed and light-shielded within the packaging. The packaging that houses a plurality of beverage containers and one or more-volumetric dispenser, described hereinafter, will be called a "product configuration." The product configuration could be sold at retail in the same manner as other containers of multi-pack beverages and could be marketed in close proximity thereto where permitted by law. The configuration is designed to permit the convenience of carrying base beverage containers and one or more mix beverage containers for later mixing by use of a volumetric dispenser. The base beverage containers are designed for single-serve and the base beverage may be carbonated, while the one or more multi-serve mix beverage containers may contain a beverage or spirit, and are proportionally sized to provide equal division among the base beverage containers by use of the volumetric dispenser provided in the bundle.

The one or more volumetric dispensers provides proportional distribution of the mix beverage to each base beverage.

The invention complies with authorized standards of fill (alcohol packaging standards), particularly those listed in 27 Code of Federal Regulations (CFR) §5.47a, which require that distilled spirits containers, other than cans, be filled to 50 mL, 100 mL, 200 mL, 375 mL, 750 mL,1 L, or 1.75 L.

A preferred embodiment of the product configuration is comprised of a light-shielded package made of sturdy, rigid or semi-rigid material, including, but not limited to, cardboard, paperboard, reinforced cloth, plastic, carbon fiber, metal, or other packaging material u. The first function of the product configuration is to allow merchants to market and sell the beer and spirits as a bundle of unmixed beverages. The second function is to allow consumers to transport the multiple beverages in a single package for later mixing of the base beverage with the mix beverage in the proper ratio using the included volumetric dispenser, whereby none of the beverages are wasted when properly mixed. The third function is to prevent light from denaturing the alcohol. An aspect of this invention is that the dispensing device is specially designed to be of a volumetric size that is equal to the number of base beverages when divided by the volume of the mixed beverage container. When combining the base beverage and mix beverage in the correct proportion using the premeasured volumetric dispenser. For Example, if there are included five base beverage containers within the product configuration and the volume of the mix beverage container was 200 mL, than the volumetric dispenser would have a volume of 40 mL, to allow for an equal amount of mix beverage to be combined with each of the five individual base beverage containers.

One embodiment of the product configuration is made of sturdy material that allows it to contain the individual beverages without tearing or disintegrating. In the preferred embodiment, it is a rectangular box made of cardboard similar in shape and size to a typical package of six canned beverages, except that it contains only five units of beer and a bottle of spirits with a volumetric dispenser resting on top of the mix beverage container. The general concept of this package container can be extended or reduced to fit beverages of other numbers, particularly but not exclusively including factors of six, such as twelve, eighteen, twenty-four, and thirty-two individual beverage units. This and alternate embodiments are described herein.

BRIEF DESCRIPTION OF THE DRAWINGS

Like reference numbers and designations in the various drawings indicate like elements.

DETAILED DESCRIPTION OF THE PREFERRED EMBODIMENTS

An exemplary preferred embodiment in accordance with the present invention is described below, and illustrated in FIG.'s 1-4. In this embodiment, the package 1 includes, five base beverage containers 2 packaged in this package are beer cans, and a mix beverage container 3 is liquor. The volumetric dispenser in the shape of a shot glass 4, is inverted over the mix beverage container of liquor. Other types of dispensers in the shape of a shot glass may be used, but with differing volume to modify the flavor of the mixed drink. In this embodiment, the package is a rectangular box made of cardboard similar in shape and size to a typical package of six canned beverages, except that it contains only five base beverage containers of beer and a mix beverage container liquor capped by a volumetric dispenser. The package may be composed of a rigid or semi-rigid material of sufficient strength to support five individual base beverage containers of canned beer or some similar beverage such as a malt alcoholic beverage, and one individual mix beverage container of bottled liquor. The package is preferably composed of a light-shielding material to prevent light from denaturing the alcohol. Exemplary materials for the package include but are not limited to: cardboard, paperboard, reinforced cloth, plastic, carbon fiber, metal, or other packaging material.

Figure 1:
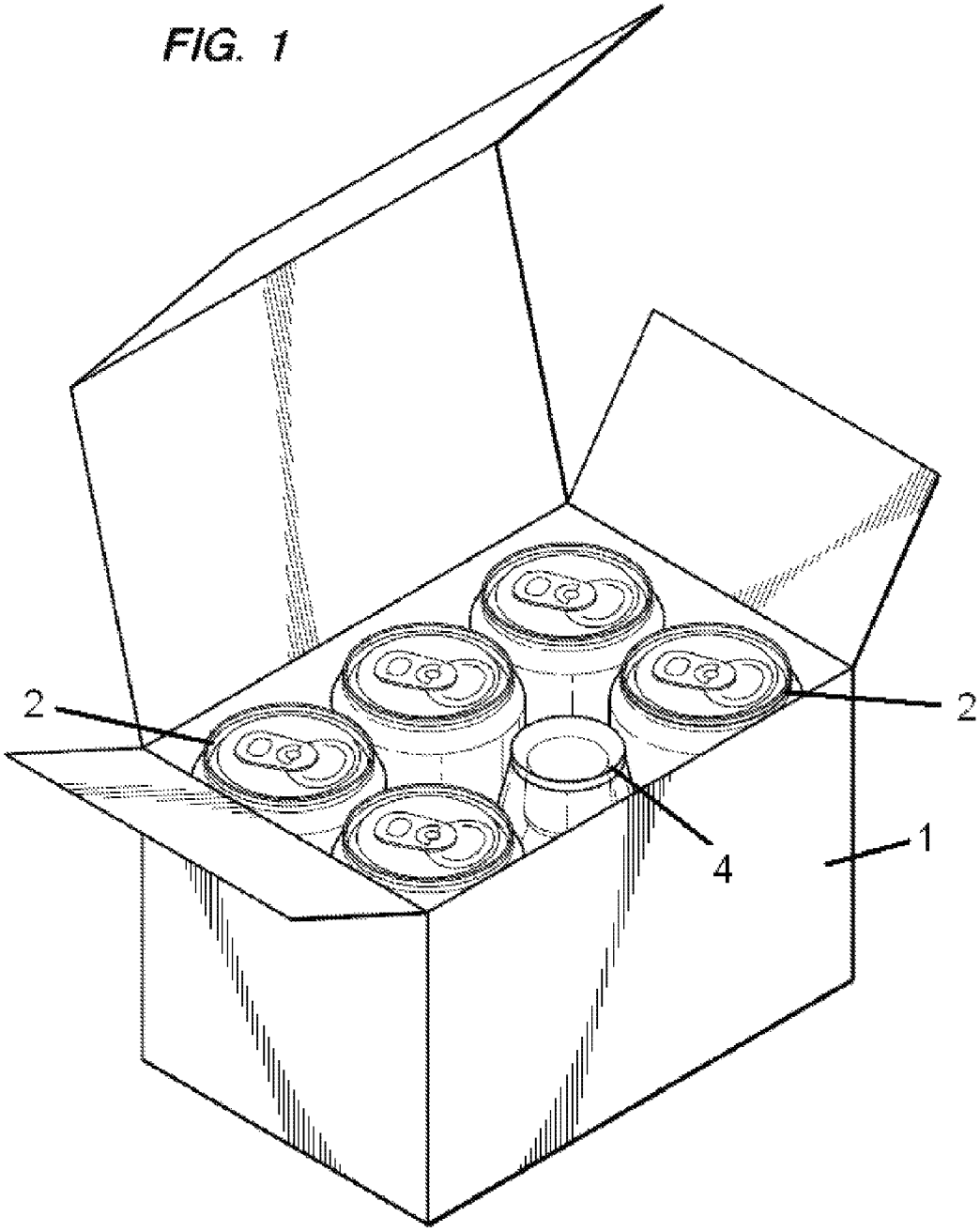
FIG. 1 is a front perspective view of a first embodiment of the package. This perspective view is in accordance with the present invention, illustrating the package when opened. This figure does not include the artwork on the box. In this case, the plurality of beverage units are five cans of beer and a single bottle of the liquor.

FIG. 1 illustrates a front elevation view of the exemplary preferred embodiment described above. The package is shown opened. The exterior of the package container may have artwork thereon, which is not shown.

Figure 2:
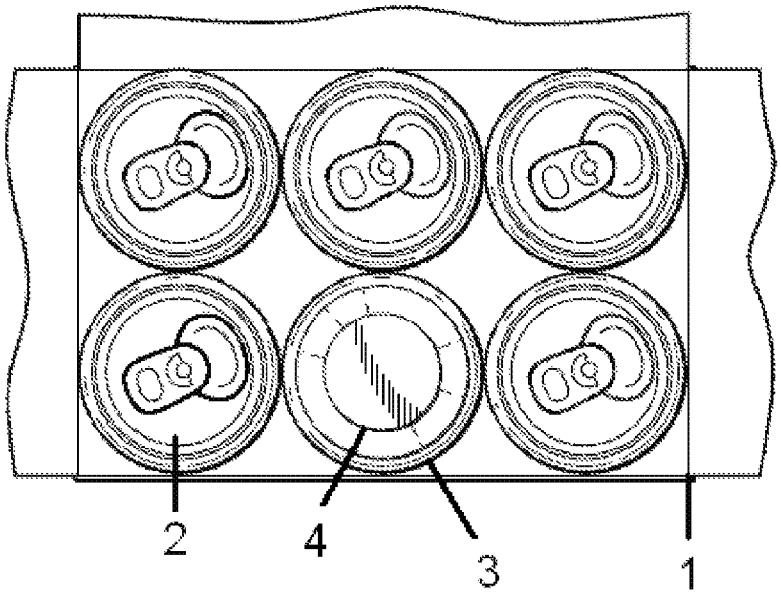
FIG. 2 is a top perspective view of the package of FIG. 1. Again, this figure does not include the artwork on the box.
Figure 3:
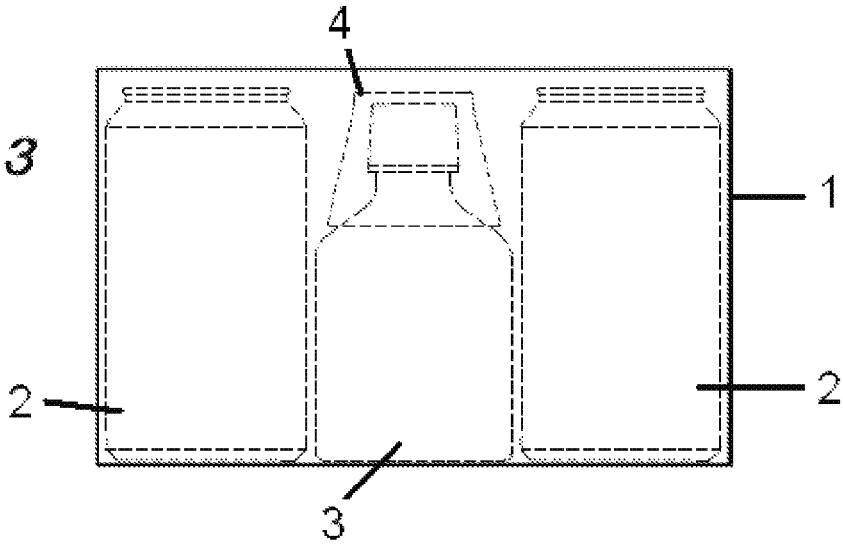
FIG. 3 is a front side perspective view of the package shown in FIG. 1.
Figure 4:
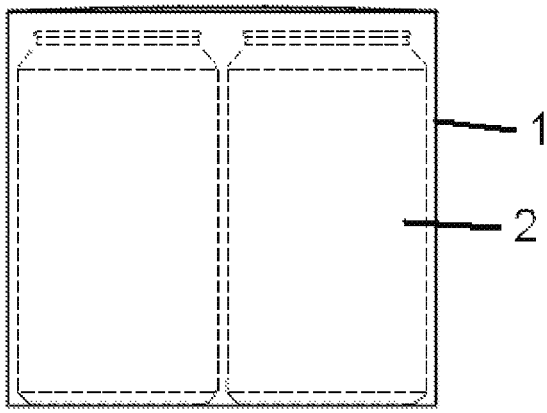
FIG. 4 is a left side perspective view of the package shown in FIG. 1.

FIG. 2 is a top perspective view of the embodiment of FIG. 1; FIG. 3 is a front side perspective view of the embodiment of FIG. 1, and FIG. 4 is a left side perspective view of the embodiment of FIG. 1.

Figure 5:
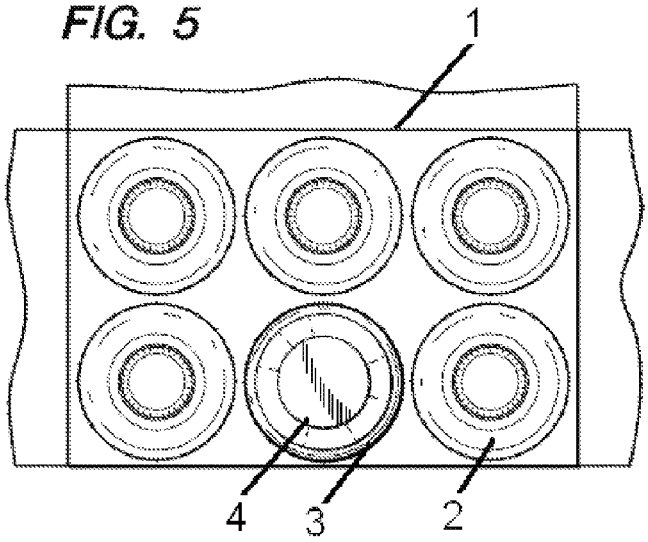
FIG. 5 is a top perspective view of another embodiment where the plurality of beverage units are all glass bottles.
Figure 6:
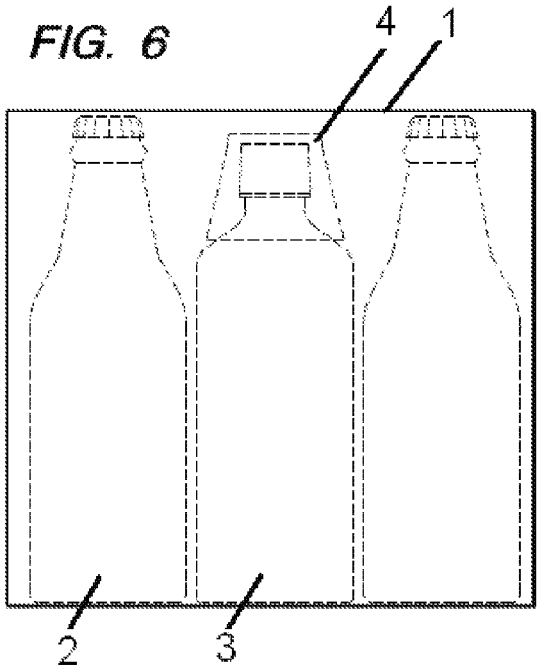
FIG. 6 is a front side perspective view of the package shown in FIG. 5.
Figure 7:
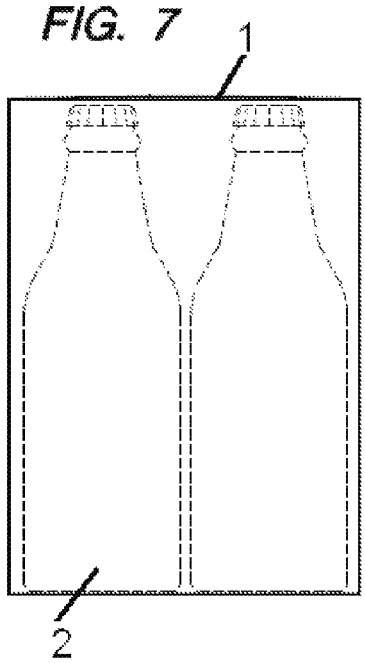
FIG. 7 is a left side perspective view of the package shown in FIG. 5.

A second exemplary embodiment is illustrated in FIG.'s 5-7. This embodiment differs from the embodiment of FIG.,'s 1-4 in that the plurality of beverage units, including the beer and the liquor, are all glass bottles. FIG.5 is a top perspective view, FIG. 6 is a front side perspective view, and FIG. 7 is a left side perspective view of this second embodiment.

Figure 8:
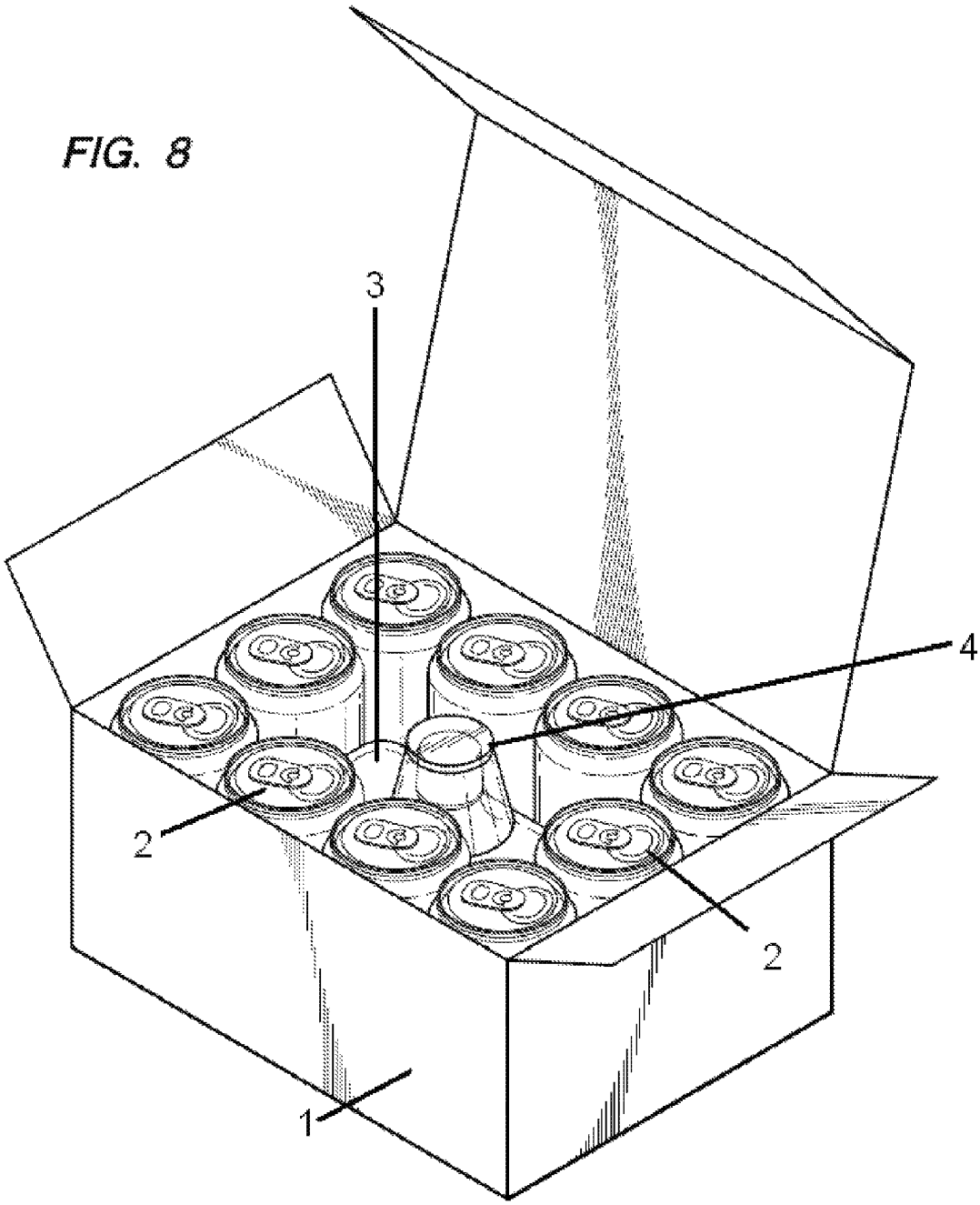
FIG. 8 is an opened front elevation view illustrating a preferred embodiment of the arrangement of the individual beverage units within the package. In this case, the plurality of beverage units are ten cans of beer and a single bottle of the liquor.
Figure 9:
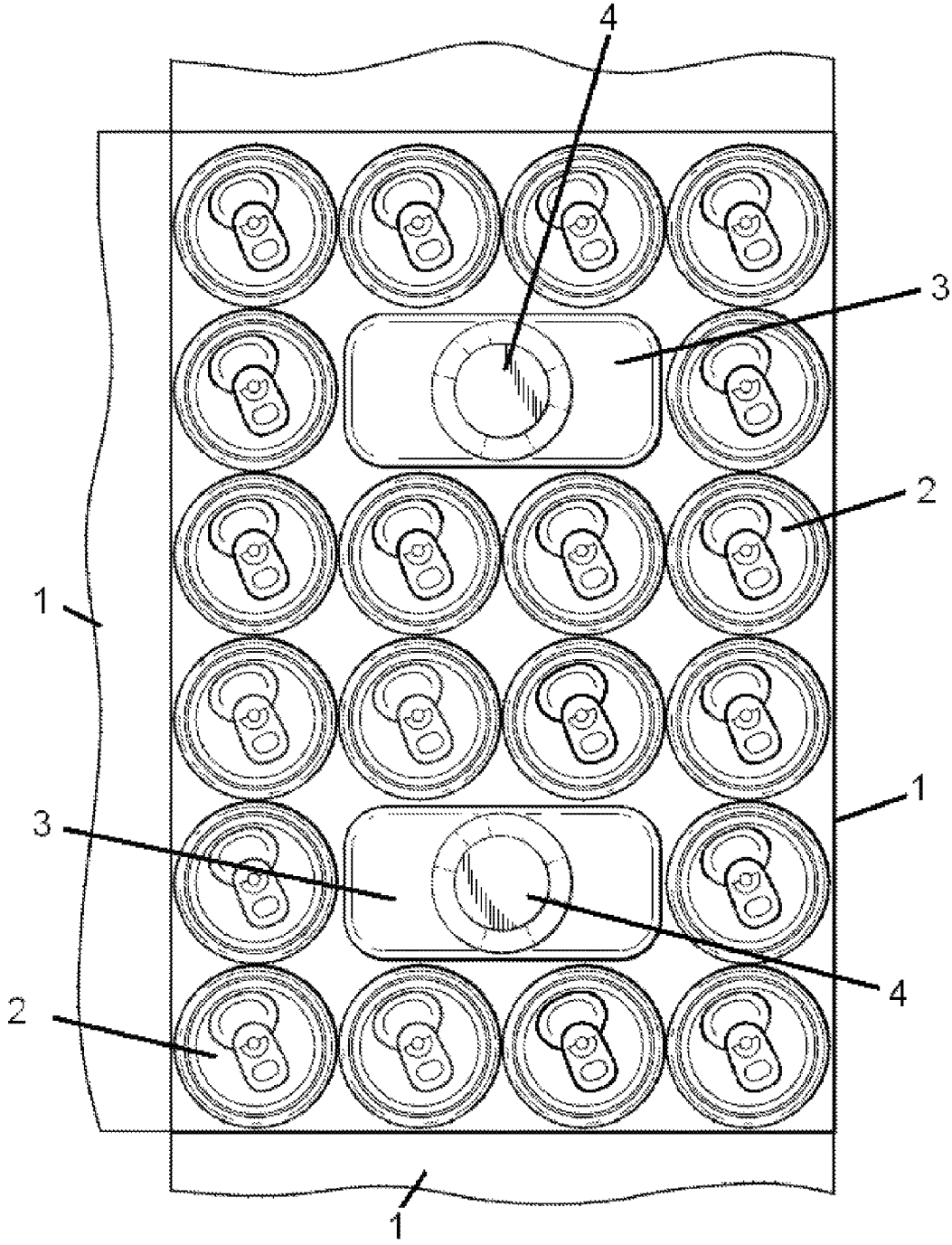
FIG. 9 is a top perspective view of an alternative embodiment of the package to contain 20 individual beverage units.

A third exemplary embodiment comprises a package holding a larger number of beer beverage units than the five beer units of the first two embodiments. FIG. 8 shows a front elevation view of an opened package with ten cans of beer and one liquor module in the center. FIG. 9 shows a top perspective view of a package with 20 cans of beer (2*a*) and 2 liquor modules (2*b*). The liquor modules are configured to 1) conform to the metric standards of fill, and 2) to contain sufficient liquor to accompany or mix with the number of beer modules.

The multi-beverage packaging configuration disclosed herein provides convenience in purchasing and transporting multiple types of beverages including alcoholic beverages, for separate consumption or for mixing.

It is not expected that the invention be restricted to the exact embodiments disclosed herein. Modifications can be made without departing from the inventive concept. For example other packaging materials for the package than those listed can be used. The scope of the invention should be construed in view of the claims.

What is claimed is:

1. A product configuration comprising:

a plurality of base beverage containers, each containing a base beverage;

a mix beverage container, containing a mix beverage;

a volumetric dispenser; and a package configured to contain said plurality of base beverage containers, said mix beverage container; and said volumetric dispenser;

wherein;

said volumetric dispenser having a volume; and wherein the volume of the volumetric dispenser multiplied by the number of said plurality of base beverage containers equals the volume of the mix beverage container;

said volumetric dispenser thereby sized so as to substantially completely and equally dispense the contents of said mix beverage container into all said base beverage containers yielding substantially equal portions of mix beverage in a number equal to the number of said plurality of base beverage containers, one said substantially equal portion of mix beverage to be mixed with the contents of each of said base beverage containers.

2. The product configuration of claim 1, wherein N equals 6.

3. The product configuration of claim 2, wherein the volume of the mix beverage container equals 200 mL, and equals 40 mL.

4. The product configuration of claim 1, wherein N equals 11.

5. The product configuration of claim 1, wherein the base beverage is beer and the mix beverage is liquor.

6. The product configuration of claim 1, wherein said package is rectangular in shape.

7. The product configuration of claim 1, wherein said package is comprised of a light-shielded container made of sturdy, rigid or semi-rigid material from the group consisting of: cardboard, paperboard, reinforced cloth, plastic, carbon fiber, and metal.

8. A product configuration comprising:

a plurality of base beverage containers, each containing a base beverage;

a plurality of mix beverage containers, each containing a mix beverage;

at least one volumetric dispenser; and a package configured to contain said plurality of said base beverage containers, said mix beverage containers; and said at least one volumetric dispenser;

wherein;

the combined volume of all said plurality of base beverage containers is greater than the combined volume of all said mix beverage containers;

and wherein the number of said base beverage containers multiplied by the volume of one said volumetric dispenser equals the total volume of said plurality of mix beverage containers;

each said volumetric dispenser sized so as to substantially completely and equally dispense the combined contents of said mix beverage containers into all said individual base beverage containers in equal portions, with one said equal portion equal to the volume of one said volumetric dispenser to be mixed with the contents of each said base beverage container.

9. The product configuration of claim 8, wherein said base beverage is beer and said mix beverage is liquor.

10. The product configuration of claim 8, wherein said mix beverage is liquor, the volume of each said volumetric dispenser equals 40 mL.

11. The product configuration of claim 8, wherein said package is stackable and comprised of a light-shielded container made of sturdy, rigid or semi-rigid material from the group consisting of: cardboard, paperboard, reinforced cloth, plastic, carbon fiber, and metal.

12. A product configuration comprising:

a plurality of individual beverage containers;

at least one volumetric dispenser; and a package configured to contain said plurality of individual beverage containers, and said at least one volumetric dispenser;

wherein;

said plurality of individual beverage containers are composed of at least one set of a number of base beverage containers, each base beverage container having a base beverage volume, and for each set of base beverage containers, one mix beverage container having a mix beverage volume;

each said at least one volumetric dispenser having a volumetric dispenser volume and wherein the volumetric dispenser volume multiplied by the number of base beverage containers of one said set equals the mix beverage volume of said one mix beverage container of one said set;

each said at least one volumetric dispenser thereby sized to substantially completely and equally dispense the contents of each said mix beverage container of a said set into substantially equal portions equal to the number of base beverage containers of the said set, with one said substantially equal portion to be mixed with the contents of a base beverage container of the said set.

* * * * *